US010538963B2

(12) United States Patent
Anthony et al.

(10) Patent No.: US 10,538,963 B2
(45) Date of Patent: Jan. 21, 2020

(54) WAND FOR ARCHITECTURAL COVERING

(71) Applicant: Hunter Douglas Inc., Pearl River, NY (US)

(72) Inventors: James M. Anthony, Denver, CO (US); Kevin M. Dann, Englewood, CO (US); Jeffrey L. Spray, Erie, CO (US)

(73) Assignee: HUNTER DOUGLAS INC, Pearl River, NY (US)

( * ) Notice: Subject to any disclaimer, the term of this patent is extended or adjusted under 35 U.S.C. 154(b) by 209 days.

(21) Appl. No.: 15/420,124

(22) Filed: Jan. 31, 2017

(65) Prior Publication Data

US 2017/0241197 A1 Aug. 24, 2017

Related U.S. Application Data

(60) Provisional application No. 62/297,783, filed on Feb. 19, 2016.

(51) Int. Cl.
*E06B 9/78* (2006.01)
*E06B 9/326* (2006.01)

(52) U.S. Cl.
CPC ..... *E06B 9/326* (2013.01)

(58) Field of Classification Search
CPC ... E06B 9/326; E06B 9/78; E06B 9/26; E06B 9/262; E06B 9/30; E06B 9/303; E06B 9/32; E06B 9/322; E06B 9/68; E06B 2009/785; E06B 2009/2622; E06B 2009/2625; E06B 2009/2627; Y10T 16/44; Y10T 16/444; Y10T 16/466; Y10T 16/469; Y10T 16/476
USPC ..... 160/319, 320, 84.01–84.05, 168.1 R, 160/173 R, 177 R, 178.1 R; 16/110.1, 16/111.1
See application file for complete search history.

(56) References Cited

U.S. PATENT DOCUMENTS

| | | | | | |
|---|---|---|---|---|---|
| 1,796,721 | A | * | 3/1931 | Price | F16K 31/602 16/110.1 |
| 2,372,142 | A | | 3/1945 | Warren, Jr. | |
| 3,470,764 | A | | 10/1969 | Frymire | |
| 3,517,931 | A | * | 6/1970 | Kalish | A63B 5/20 482/82 |
| 3,633,646 | A | * | 1/1972 | Zilver | E06B 9/305 160/168.1 R |
| 4,136,866 | A | * | 1/1979 | Bouvier | A63B 5/20 16/430 |
| 4,375,886 | A | * | 3/1983 | Muys | A63B 5/20 482/82 |
| 4,563,002 | A | * | 1/1986 | Jardine | A63B 5/20 482/82 |
| 4,735,035 | A | | 4/1988 | Mattioli | |

(Continued)

FOREIGN PATENT DOCUMENTS

| | | | | |
|---|---|---|---|---|
| AU | 201614389 | | 1/2017 | |
| GB | 996314 | A | 6/1965 | |
| GB | 2517547 | A * | 2/2015 | E06B 9/326 |

*Primary Examiner* — Johnnie A. Shablack

(57) ABSTRACT

A covering for an architectural opening may include a shade movable between extended and retracted positions, and a wand having a rod with a top end and a bottom end. The top end of the wand may be operatively coupled to the shade via an operating cord and movable to actuate the operating cord to move the shade between the extended and retracted positions. A handle may be coupled to the bottom end of the rod.

12 Claims, 5 Drawing Sheets

(56) References Cited

U.S. PATENT DOCUMENTS 4,782,560 A * 11/1988 Keller ..... A43C 7/00 24/115 M
4,875,516 A * 10/1989 Marocco ..... E06B 9/307 160/178.1 R
5,275,222 A * 1/1994 Jelic ..... E06B 9/324 160/178.2
5,291,856 A 3/1994 Goller
5,337,450 A * 8/1994 Martin ..... E05B 3/04 16/422
5,465,779 A * 11/1995 Rozon ..... E06B 9/326 160/168.1 V
5,501,262 A * 3/1996 Inaba ..... E06B 9/323 160/173 R
5,542,462 A * 8/1996 Elsenheimer ..... E06B 9/326 16/442
5,553,649 A * 9/1996 Chisaka ..... E06B 9/306 160/168.1 R
5,553,653 A * 9/1996 Rozon ..... E06B 9/326 160/173 R
5,595,232 A * 1/1997 Benthin ..... E06B 9/361 160/178.1 R
5,709,258 A 1/1998 Coccoluto
5,722,478 A 3/1998 Claypool et al.
5,735,329 A 4/1998 Akins et al.
5,771,952 A 6/1998 Gabriel
5,787,953 A * 8/1998 Jacobson ..... B25B 15/06 160/168.1 R
5,819,832 A * 10/1998 Huang ..... E06B 9/303 160/168.1 R
5,904,198 A * 5/1999 Huang ..... E06B 9/303 160/168.1 R
5,919,542 A * 7/1999 Chou ..... E06B 9/326 16/428
6,089,303 A * 7/2000 Metcalf ..... E06B 9/307 160/176.1 R
6,189,595 B1 * 2/2001 Lee ..... E06B 9/303 160/168.1 R
6,196,293 B1 * 3/2001 Lee ..... E06B 9/303 160/168.1 V
6,334,477 B1 * 1/2002 Moir ..... E06B 9/264 160/168.1 V
6,516,860 B1 * 2/2003 Weaver ..... E06B 9/30 160/168.1 R
6,752,194 B1 6/2004 Huang
6,792,995 B2 * 9/2004 Judkins ..... E06B 9/326 160/173 R
6,805,186 B1 * 10/2004 Nien ..... E06B 9/322 160/177 R
7,281,564 B2 10/2007 Dekker
7,346,958 B2 * 3/2008 Parsons ..... F41B 15/022 16/110.1
7,383,871 B2 * 6/2008 Osinga ..... E06B 9/326 160/178.1 R
7,578,334 B2 8/2009 Smith et al.
7,779,886 B2 * 8/2010 Ganzi ..... E06B 9/322 160/168.1 R
8,113,262 B2 * 2/2012 Gillis ..... E06B 9/38 16/111.1
8,739,852 B2 * 6/2014 Anderson ..... E06B 9/326 160/168.1 R
8,997,827 B2 * 4/2015 Anderson ..... E06B 9/262 160/170
9,103,158 B2 * 8/2015 Martinez ..... E06B 9/326
9,151,110 B2 * 10/2015 Vestal ..... E06B 9/303
9,187,951 B2 * 11/2015 Yu ..... E06B 9/322
9,217,281 B2 * 12/2015 Huang ..... E06B 9/40
9,284,774 B2 * 3/2016 Yu ..... E06B 9/38
9,371,691 B2 * 6/2016 Yu ..... E06B 9/68
9,416,588 B2 * 8/2016 Cheng ..... E06B 9/326
9,487,997 B2 11/2016 Kovach et al.
9,550,086 B1 * 1/2017 Poirier ..... A63B 5/20
9,657,517 B2 * 5/2017 Huang ..... E06B 9/78
2006/0011310 A1 1/2006 Chou
2008/0173414 A1 7/2008 Cheng
2011/0100569 A1 5/2011 Perkowitz
2012/0285631 A1 * 11/2012 Zhu ..... E06B 9/32 160/84.01
2013/0042985 A1 * 2/2013 Liu ..... E06B 9/303 160/340
2013/0319622 A1 * 12/2013 Kovach ..... E06B 9/326 160/173 R
2014/0290876 A1 * 10/2014 Chen ..... E06B 9/307 160/170
2014/0311686 A1 * 10/2014 Yu ..... E06B 9/68 160/84.02
2015/0007946 A1 * 1/2015 Yu ..... E06B 9/38 160/84.02
2015/0075728 A1 * 3/2015 Tachikawa ..... E06B 9/384 160/168.1 R
2015/0191970 A1 * 7/2015 Yu ..... E06B 9/262 160/84.02
2015/0300083 A1 * 10/2015 Manske ..... E06B 9/322 16/429
2015/0376944 A1 * 12/2015 Huang ..... E06B 9/262 160/168.1 P
2016/0017964 A1 * 1/2016 Yu ..... E06B 9/32 160/168.1 P
2016/0270578 A1 * 9/2016 Tachikawa ..... E06B 9/326
2017/0009522 A1 1/2017 Kovach et al.
2017/0145744 A1 * 5/2017 Diamond ..... E06B 9/326
2017/0191310 A1 * 7/2017 Huang ..... E06B 9/262
2017/0241197 A1 * 8/2017 Anthony ..... E06B 9/326
2018/0094480 A1 * 4/2018 Kovach ..... E06B 9/326
2018/0106105 A1 * 4/2018 Anthony ..... E06B 9/72

* cited by examiner

WAND FOR ARCHITECTURAL COVERING

CROSS REFERENCE TO RELATED APPLICATION

This application claims the benefit of priority under 35 USC § 119(e) of the earlier filing date of U.S. Provisional Patent Application No. 62/297,783 filed 19 Feb. 2016 and entitled "Wand for Architectural Covering," which is hereby incorporated by reference in its entirety.

FIELD

The present disclosure relates generally to architectural coverings, and more specifically to a wand for operating an architectural covering.

BACKGROUND

Retractable architectural coverings, such as coverings for structures, including walls and openings, such as windows, doorways, archways, or other architectural structure or feature, can be operated in numerous ways. Some retractable coverings include a flexible cord suspended from an end of a head rail. The flexible cord is operatively connected to a control mechanism within the head rail to move a shade material suspended from the head rail between extended and retracted positions across a respective architectural opening. The flexible cord can become entangled with itself, or may be formed into a loop about another object.

Some retractable coverings include a rigid wand, such as in the form of a rod, connected to an operating mechanism for opening or closing vanes or slats in the covering by twisting the wand about its longitudinal axis. An example of such a wand is conventionally found in Venetian blinds where the slats are tilted between open and closed positions by rotating such a wand, and a flexible cord, which is susceptible to becoming entangled with itself as mentioned above, is used to raise or lower the blind.

SUMMARY

The present disclosure is at least partially directed to a wand that alleviates at least to a certain extent one or more of the aforementioned problems, addresses at least to a certain extent difficulties of prior wands, and/or generally provides a user with different wand options.

The present disclosure generally provides a wand for operating an architectural covering (such as a covering for a window, door, archway, or other architectural structure or feature). The wand may be connected to a flexible operating cord of an operating system for operating the architectural covering. The flexible operating cord may be substantially retracted to an inaccessible position, such as within the head rail, during non-use. During use, the flexible operating cord may be temporarily extended from the head rail in a taut condition and may be biased to automatically retract after a downward force on the wand is no longer applied to the wand. In this manner, the wand may be used by a user to operate the covering and the flexible operating cord may be substantially prevented from forming a loop.

The wand may comprise a rigid or semi-rigid rod ending with a handle for grasping by the user or operator of the shade. The rod may comprise a glass-filled polymer, a fiberglass composite, metal, wood, or other rigid or partially rigid materials. The rod may be coated (e.g., plated, overmolded, or otherwise coated) with an elastomeric material, such as a rubber material, to improve gripping of the wand and/or provide a desired tactile feel of the wand. The rod may be painted to provide a desired appearance, and then the coating may be applied to the painted surface. The coating may provide some additional rigidity to the rod.

The present disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular examples or arrangements illustrated herein.

BRIEF DESCRIPTION OF THE DRAWINGS

The accompanying drawings, which are incorporated into and constitute a part of the specification, illustrate examples of the disclosure and, together with the general description given above and the detailed description given below, serve to explain the principles of these examples.

DETAILED DESCRIPTION

The present disclosure generally provides a wand for operating an architectural covering. The wand may be connected to a flexible operating cord of an operating system for operating the architectural covering. The flexible operating cord may be substantially retracted to an inaccessible position, such as within the operating system, during non-use. During use, the flexible operating cord may be temporarily extended from the operating system in a taut condition and may be biased to automatically retract after a downward force on the wand is no longer applied to the wand. In this manner, the wand may be used by a user to operate the covering and the flexible operating cord may be substantially prevented from forming a loop.

Figure 1:
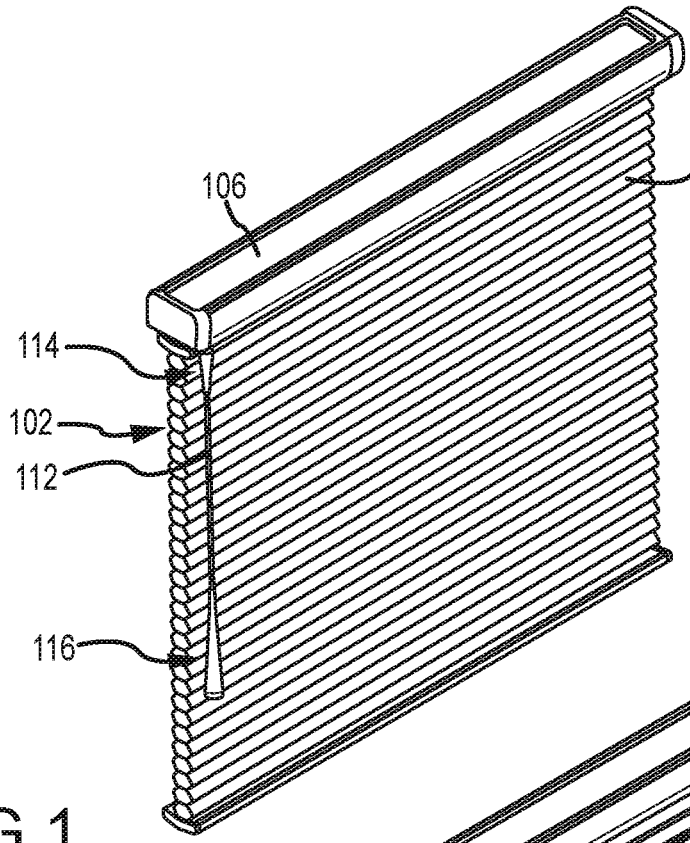
FIG. 1 is an isometric view of a retractable covering including a shade in an extended position and a wand for moving the shade in accordance with an embodiment of the present disclosure.
Figure 2:
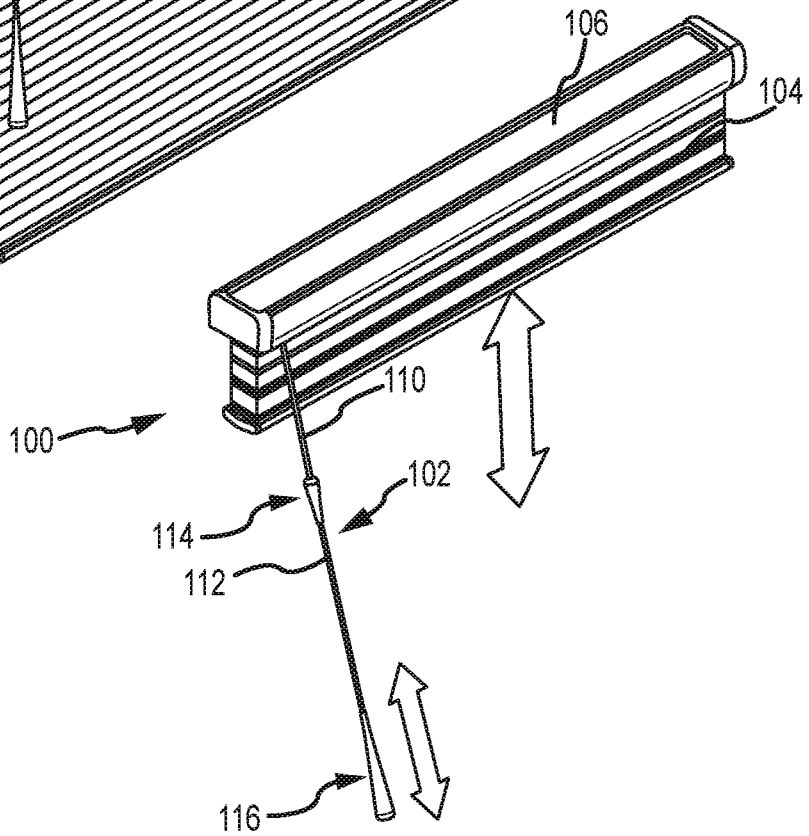
FIG. 2 is an isometric view of the covering of FIG. 1 with the shade in a retracted position and the wand extended from a head rail in accordance with an embodiment of the present disclosure.

FIGS. 1 and 2 illustrate an example of a covering 100 for an architectural opening (such as a window, door, archway, or other architectural opening). The covering 100 may include a wand 102 operably associated with a retractable shade 104. In one embodiment, the shade 104 may be suspended from a head rail 106 of the covering 100. For example, the wand 102 may be manipulated by a user to move the shade 104 between an extended position (see FIG. 1) and a retracted position (see FIG. 2). The wand 102 may be sufficiently rigid such that the wand 102 may be substantially prevented from forming a loop. The wand 102 may be semi-rigid or rigid, and the amount of rigidity may be varied depending on the desired degree of rigidity. The covering 100 illustrated in FIGS. 1 and 2 is shown for illustrative purposes only, and the wand 102 may be used with other types of coverings, including various types of covering elements, shade materials, or other covering components.

With continued reference to FIGS. 1 and 2, the wand 102 may be suspended from the head rail 106 and may be accessible to a user for manipulation thereof. The wand 102 may be attached to an operating cord 110, which in turn may be attached to a drive pulley or other drive mechanism for converting axial movement of the wand 102 into another movement, such as a rotational torque, for retracting and/or extending the shade 104. While the wand 102 may be used with many types of operating systems, in some embodiments the wand 102 may be used with an operating system using a unidirectional or ratchet-type drive mechanism. As seen in the illustrative embodiment of FIG. 2, the wand 102 may be pulled downwardly to either raise or lower the shade 104, and the downward movement of the wand 102 may extend the operating cord 110 from the head rail 106. The operating system may retract the operating cord 110 after the downward force applied to the wand 102 is removed, thereby raising the wand 102 to its retracted position (see FIG. 1). In this manner, a user may reciprocally pull the wand 102 away from the head rail 106 to move the shade 104 between extended and retracted positions. As a force is applied to the wand 102 to extend the operating cord 110 from the head rail 106, the wand 102 may resiliently bend along its length, but it may be sufficiently rigid to prevent the formation of a loop. The operating system may maintain the operating cord 110 under tension, thereby substantially preventing the operating cord 110 from forming a loop during operation of the covering 100.

Figure 3:
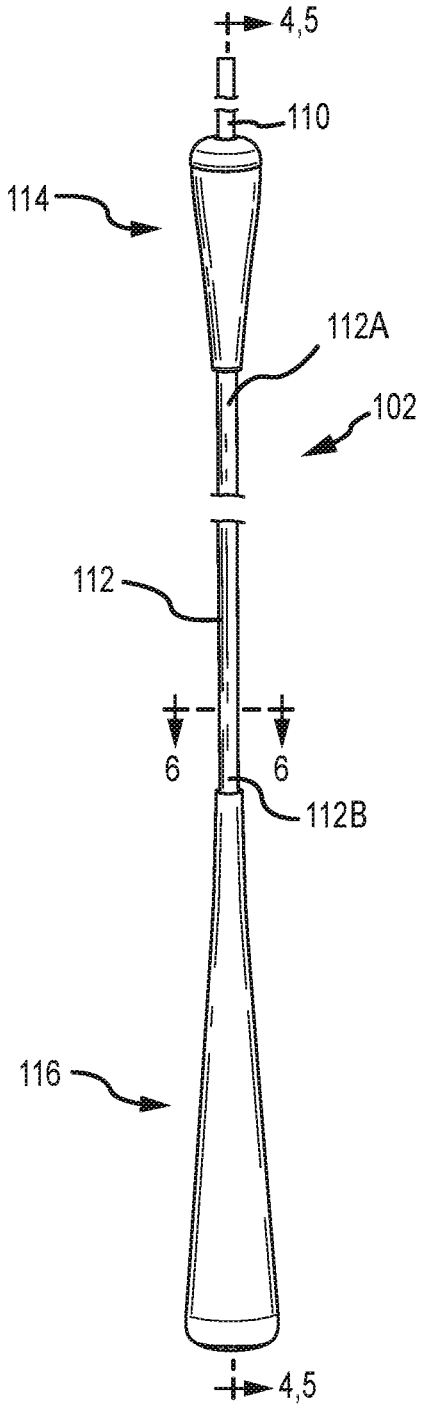
FIG. 3 is an elevational view of the wand of FIG. 1 connected to an operating cord at an upper end and including a handle at a lower end.

Referring to FIGS. 1-3, the wand 102 may include a rod 112, a joiner or connector 114 (hereinafter "connector" for the sake of convenience without intent to limit) attached to an upper or top end 112A (hereinafter "upper end" for the sake of convenience without intent to limit) of the rod 112 (see FIG. 3) for connecting the wand 102 to the operating cord 110, and a handle, touch point, tassel, or other user engagement feature (hereinafter "handle", such as handle 116, for the sake of convenience without intent to limit) attached to a lower or bottom end 112B (hereinafter "bottom end" for the sake of convenience without intent to limit) of the rod 112 (see FIG. 3) to facilitate grasping of the wand 102 by a user and/or for aesthetics.

The rod 112 may be sufficiently rigid such that the rod 112 may be substantially prevented from forming a loop. The rod 112 may be semi-rigid or rigid, and the amount of rigidity may be varied depending on the desired degree of rigidity. The rigidity of the wand 102 may be determined from a number of factors, such as the material, the length, the diameter, the cross-sectional shape, or other characteristics of the rod 112. One or more of these factors may be taken into consideration when forming the wand 102 so that it has a desired rigidity to avoid forming a loop or becoming entangled. In one embodiment, the rod 112 is sufficiently rigid/self-supporting so that when the rod 112 is supported along approximately half its length on a horizontal surface, the free half of the rod 112 does not drop, deflect, or curve visually, and remains substantially horizontal. In other words, the rod 112 may have sufficient rigidity to act as a cantilever beam in supporting its own weight (or a portion thereof) when extending past a support member, such as the horizontal surface. Typical operating cords, such as the flexible operating cord 110, typically drape and would not extend past the edge of the horizontal surface and thus would drop or at least sag rather than stay substantially horizontal, such as the rod 112.

Nonetheless, the rod 112 may be somewhat flexible or bendable to bend or deflect in response to a bending force, to withstand such forces rather than to break, such limited flexibility contributing to durability of the wand 102 and also contributing to an improved perceived quality and user-friendliness of the material of the rod 112. It will, however, be appreciated that even if the rod 112 may be bent somewhat upon application of a force thereto, preferably it is sufficiently resilient to spring back to its substantial straight configuration without retaining a bend, bow, or curve, i.e., without taking a set. This may be important for aesthetic purposes, as the wand 102 is intended to replace flexible cords which are often weighted to hang substantially vertically and straight, and, therefore, preferably remains as straight as the cord the wand 102 replaces. Also, the rod 112 may hang next to a vertical member (such as a wall, trim, window, window treatment, etc.), and thus it may be discernible by a user if there is a bend, bow, or curve to the rod 112. Thus, the rod 112 may resiliently deform when a bending force is applied to the rod 112, and may return to substantially its original shape after the force is removed from the rod 112. In some embodiments, the rod 112 may be elongate and may extend in a substantially straight line from the connector 114 to the handle 116.

The rod 112 may be formed from various types of material. In some embodiments, the rod 112 may be formed from a composite material, such as a glass-filled polymer, a fiberglass composite, or other composite material. In some embodiments, the rod 112 may be a fiberglass including glass, boron, or other mineral fibers and an epoxy or other resin to hold the fibers together. In some embodiments, the rod 112 may include a fiberglass rod including a polymer coating on an exterior surface thereof. A fiberglass rod may provide a higher modulus than wood or straight plastic, permitting use of a smaller diameter for better aesthetics, for example. Addition of a mineral fiber may increase the Young's modulus (which is a measure of bending strength and ultimate tensile strength) by about $10^3$. A fiberglass composite with mineral fibers may provide a light weight as well as high strength (high strength to weight ratio) material that may be formed into a wand with a relatively thin diameter and having at least some of the characteristics described herein as useful for a wand for operating a window covering. In some embodiments, the rod 112 may have a modulus of elasticity of about 6 million psi and may be relatively light weight to provide a relatively high strength to weight ratio. For example, a fiberglass composite may have a strength to weight ratio about four times higher than wood. The rod 112 may have another modulus of elasticity, which may at least partially depend on other characteristics (e.g., the diameter, the cross-sectional shape, the length, or other characteristics) of the rod 112. It will be appreciated that although materials with higher moduli of elasticity may be used, weight may increase with increase of modulus of elasticity, and increased weight may not be desirable. The material selected for the rod 112 preferably does not take a set, and may be thermosettable.

Figure 6:
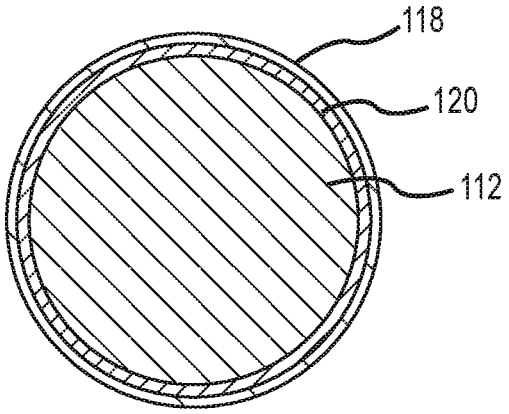
FIG. 6 is a transverse cross-sectional view of the wand of FIG. 3, illustrating a core and an outer coating taken along line 6-6 in FIG. 3.

The rod 112 may have various diameters, cross-sectional shapes, and lengths. Referring to FIG. 6, the rod 112 may have a circular cross-sectional shape. The rod 112 may have a diameter that is sufficiently large (and thus sufficiently rigid) such that the rod 112 does not form a loop or entangle itself, and yet is sufficiently small (and thus sufficiently light weight) such that the retractable spring can retract the retractable cord 110 into an operating system (such as a clutch) in the head rail 106. The illustrative rod 112 of FIG. 6 may have a diameter ranging between about 0.0625 inches and 0.200 inches, for example, so that the rod 112 may have a desired rigidity to resist forming a loop. A relatively small diameter may be desirable so that the rod 112 may be similar in appearance to previously used cords which the rod 112 replaces. Although a circular cross-sectional rod is depicted in FIG. 6, the rod 112 may have other cross-sectional shapes, such as non-circular cross-sectional shapes, including various polygonal shapes (e.g., triangular, rectangular, hexagonal, etc.). Each cross-sectional shape may have a different flex capability and thus a different impact on the overall rigidity of the rod 112. The length of the rod 112 may be varied depending on the shade. For example, the length of the rod 112 may be varied based on a height dimension of an associated architectural opening to ensure that at least the handle 116 of the wand 102 is within reach of a user. The length of the rod 112 may affect the other characteristics of the rod 112. For example, a longer rod 112 may be made of a material with a higher modulus of elasticity or may have a larger diameter to ensure the rod 112 is sufficiently rigid to prevent bending or flexing the rod 112 into a loop, relative to a shorter rod 112, because it is generally more difficult to bend or flex a shorter length of a given structure.

Referring to FIG. 6, the rod 112 may be coated (e.g., plated, overmolded, or otherwise coated) with an elastomeric material, such as a rubber material. The coating 118 may improve grasping of the rod 112, provide a desired tactile finish to the rod 112, and/or facilitate cleaning of the rod 112. For example, some users may prefer the tactile feel of an elastomeric material, which may provide a 'soft' touch or feel. The coating 118 may provide an easy-to-clean surface that is durable and/or fire resistant. The coating 118 may provide some additional rigidity to the rod 112. The thickness of the coating 118 may be varied. In some embodiments, the coating 118 may have a thickness of about 0.005 inches. The coating 118 may be colored to provide a desired appearance of the rod 112. In some embodiments, the coating 118 may be transparent or translucent, and the rod 112 may be painted (see, e.g., paint layer 120 in FIG. 6) such that the painted color of the rod 112 may be visible through the coating 118. For example, the rod 112 may include the paint layer 120 positioned between the fiberglass rod and the coating 118. The coating 118 may be formed of a polymer. The coating 118 may extend along the entire or only part of the length of the rod 112. In some embodiments, the coating 118 may terminate prior to one or more ends of the rod 112 to facilitate handling of the rod 112 during the coating process, for example.

Figure 4A:
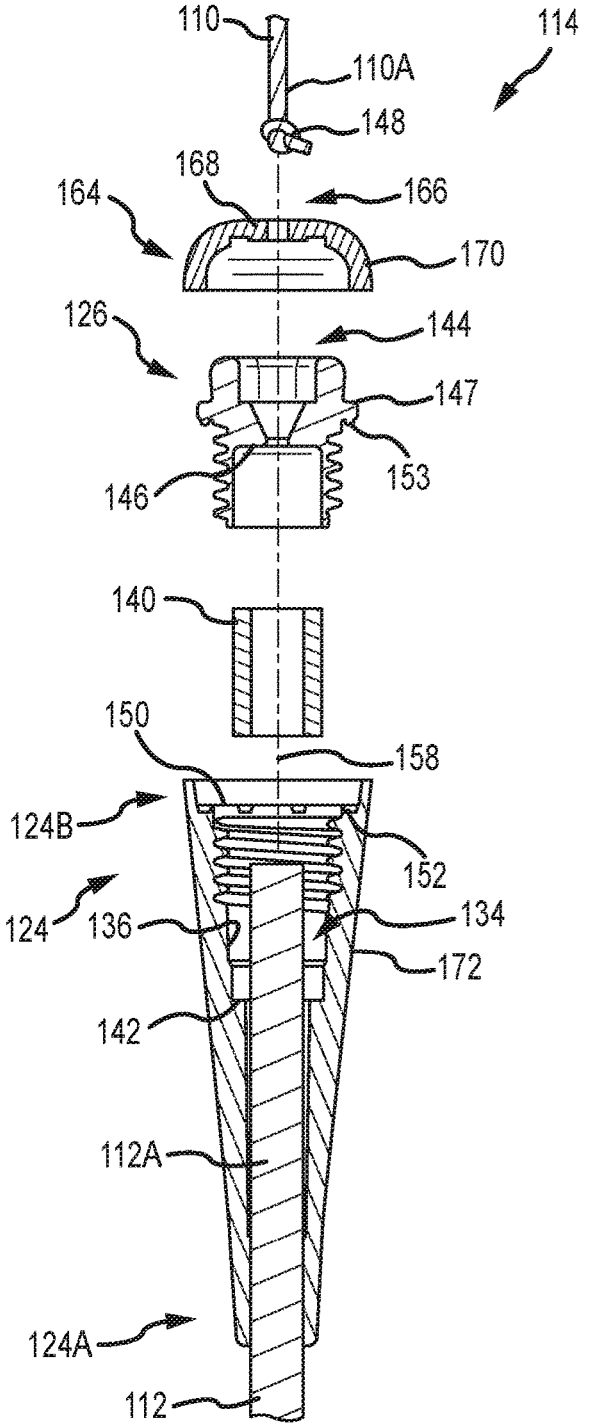
FIG. 4A is an enlarged, fragmentary, partially-exploded cross-sectional view of the upper end of the wand of FIG. 3, the cross-section generally taken along line 4-4 in FIG. 3.
Figure 4B:
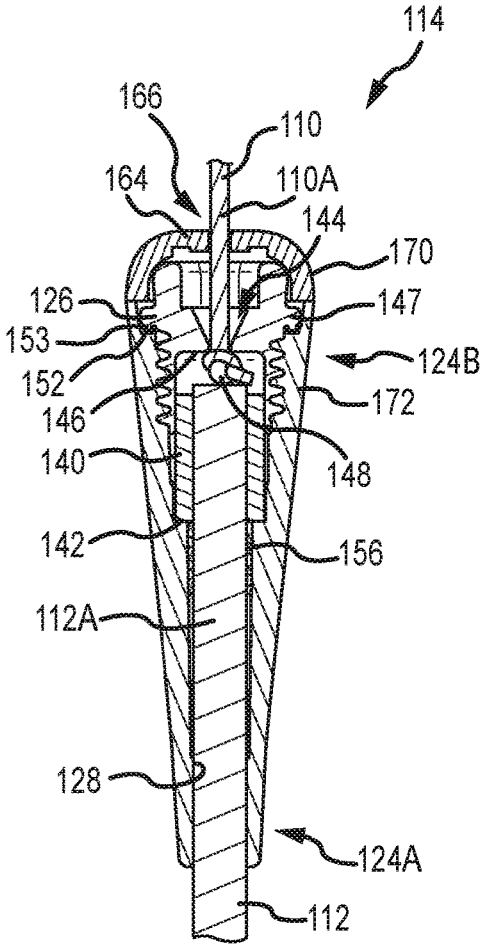
FIG. 4B is an enlarged, fragmentary, cross-sectional view of the upper end of the wand of FIG. 3, taken along line 4-4 in FIG. 3.

Referring to FIGS. 4A and 4B, the connector 114 may attach an upper end 112A of the rod 112 to a free end 110A of the operating cord 110. The connector 114 may also function as a stop and may abut against another element of the covering 100, such as against an operating system of the head rail 106 (see FIG. 1), when the wand 102 is in a fully retracted position to prevent further retraction of the operating cord 110. The connector 114 may include a first connector member 124 and a second connector member 126. The first connector member 124 may be coupled with the rod 112, the second connector member 126 may be coupled with the operating cord 110, and the first connector member 124 and the second connector member 126 may be coupled together to couple the wand 102 with the operating cord 110. When coupled together, the first connector member 124 and the second connector member 126 may be axially aligned with the rod 112.

With continued reference to FIGS. 4A and 4B, the first connector member 124 may be coupled to the upper end 112A of the rod 112 such that the first connector member 124 is not movable in an axial direction relative to the rod 112. The first connector member 124 may define an internal bore 128 extending from a first end 124A to a second end 124B of the first connector member 124. The internal bore 128 may be dimensioned to snugly receive the upper end 112A of the rod 112 near the first end 124A of the first connector member 124 and may be oversized relative to the upper end 112A of the rod 112 near the second end 124B of the first connector member 124 to define an annular space 134 between an inner surface 136 of the first connector member 124 (see FIG. 4A) and the outer surface of the rod 112. A collar or sleeve 140 (hereinafter "collar" for the sake of convenience without intent to limit) may be crimped or otherwise attached to the upper end 112A of the rod 112, and the collar 140 may be received in the annular space 134. In embodiments in which the collar 140 is crimped to the rod 112, an inner surface of the collar 140 may be compressed onto the rod 112 to slightly deform the rod 112 and to axially secure the collar 140 to the rod 112. The collar 140 may be formed from a ductile material, such as brass, to facilitate crimping. An optional coating 118 (see FIG. 6) on the exterior surface of the rod 112 may be compressed or otherwise deformed by the collar 140 and may help retain the collar 140 on the rod 112. For example, the collar 140, when crimped, may deform the coating 118 on the rod 112 to hold the collar 140 on the rod 112. The collar 140 may be inserted into the annular space 134 through the open second end 124B of the first connector member 124, and the collar 140 may abut against an internal step 142 of the first connector member 124 to prevent the collar 140 from moving axially toward the first end 124A of the first connector member 124. The collar 140 may be substantially entirely received within the annular space 134 to substantially conceal the collar 140 within the first connector member 124. Referring to FIG. 4B, the first connector member 124 may be attached to the upper end 112A of the rod 112 with adhesive 156, for example. In addition to restricting axial movement of the rod 112 relative to the first connector member 124, the adhesive 156 may restrict rotation of the rod 112 about its longitudinal axis 158 (see FIG. 4A) relative to the first connector member 124.

Referring still to FIGS. 4A and 4B, the second connector member 126 may be coupled with the operating cord 110 in substantially any manner, such as by adhesive, fasteners, or the like. In some embodiments, the free end 110A of the cord 110 may be threaded through an aperture 144 formed through a transverse wall 146 of the second connector member 126 and a knot 148 may be formed in the cord 110 to couple the cord 110 with the second connector member 126. The knot 148 may be wider than the aperture 144 to prevent the knot 148 from passing through the aperture 144. In some embodiments, a collar (such as a bead) may be attached to the cord 110 to couple the second connector member 126 with the operating cord 110.

With further reference to FIGS. 4A and 4B, the first connector member 124 and the second connector member 126 may be coupled together to couple the wand 102 with the operating cord 110. In the illustrative embodiment of FIGS. 4A and 4B, the first connector member 124 and the second connector member 126 may be threaded together. For example, the second end 124B of the first connector member 124 may be internally threaded, and the second connector member 126 may be externally threaded for threaded engagement with the first connector member 124. The second connector member 126 may include a peripheral rim 147, which may abut against an internal shoulder 150 of the first connector member 124 when the second connector member 126 is fully engaged with the first connector member 124. One or more recesses 152 may be formed in the shoulder 150 and may receive one or more bumps 153 projecting from an underside of the rim 147 when the second connector member 126 is fully engaged with the first connector member 124 to resist unthreading of the second connector member 126 from the first connector member 124 during use of the wand 102. As seen in the illustrative embodiment of FIG. 4B, the collar 140 may be received at least partially within the second connector member 126 when the second connector member 126 is fully engaged with the first connector member 124 to provide a compact arrangement and to shorten the overall length of the connector 114. In some embodiments, the upper end 112A of the rod 112 and/or the collar 140 may contact the knot 148 to further restrict axial movement of the first connector member 124 relative to the rod 112. By coupling the wand 102 with the flexible operating cord 110, the connector 114 may transmit an axial force applied to the wand 102 to the flexible operating cord 110 to operate the shade 104.

Referring still to FIGS. 4A and 4B, a bumper or cap 164 (hereinafter "cap" for the sake of convenience without intent to limit) may be positioned between the second connector member 126 and an adjacent portion of the covering 100, such as an operating system of the head rail 106 (see FIG. 1) to absorb an impact force between the wand 102 and the head rail 106, thereby reducing noise if the wand 102 is released by a user in an extended position (see FIG. 2) and the operating cord 110 retracts the wand 102 until it contacts the head rail 106 (see FIG. 1). The cap 164 may be formed of an elastomeric material, such as rubber, to facilitate absorption of the impact force. To secure the cap 164 to the operating cord 110, the free end 110A of the cord 110 may be threaded through an aperture 166 formed through a base 168 of the cap 164.

With continued reference to FIGS. 4A and 4B, the cap 164 may be attached to at least one of the first connector member 124 or the second connector member 126. For example, the cap 164 may be fitted over (such as by a snap fit or other type of interference fit to maintain the cap 164 in position) onto the first connector member 124 or the second connector member 126. In the illustrative embodiment of FIGS. 4A and 4B, the cap 164 may be coupled with the second connector member 126 and may abut against the second end 124B of the first connector member 126 to provide a smooth transition, such as a flush transition, between an outer surface 170 of the cap 164 and an outer surface 172 of the first connector member 124. The cap 164 may enclose the second end 124B of the first connector member 124 to provide a finished appearance and substantially to prevent ingress of dirt or other debris into an interior of the connector 114.

With continued reference to FIGS. 4A and 4B, the first connector member 124 may taper from a larger top diameter to a smaller bottom diameter to conform the smaller bottom diameter of the first connector member 124 to the diameter of the rod 112. For example, the outer surface 172 of the first connector member 124 may taper inwardly toward the rod 112 from the second end 124B to the first end 124A of the first connector member 124 to provide a substantially seamless transition between the first connector member 124 and the rod 112. In some embodiments, the outer surface 172 of the first connector member 124 may be substantially conical. The outer surface 170 of the cap 164 may be substantially dome shaped, and the respective dimensions of the outer surfaces 170, 172 of the cap 164 and the first connector member 124 may substantially match each other at the interface between the cap 164 and the first connector member 124 to provide a substantially seamless transition from the first connector member 124 to the cap 164, thereby providing an aesthetically pleasing matching diameter and contour.

Figure 5A:
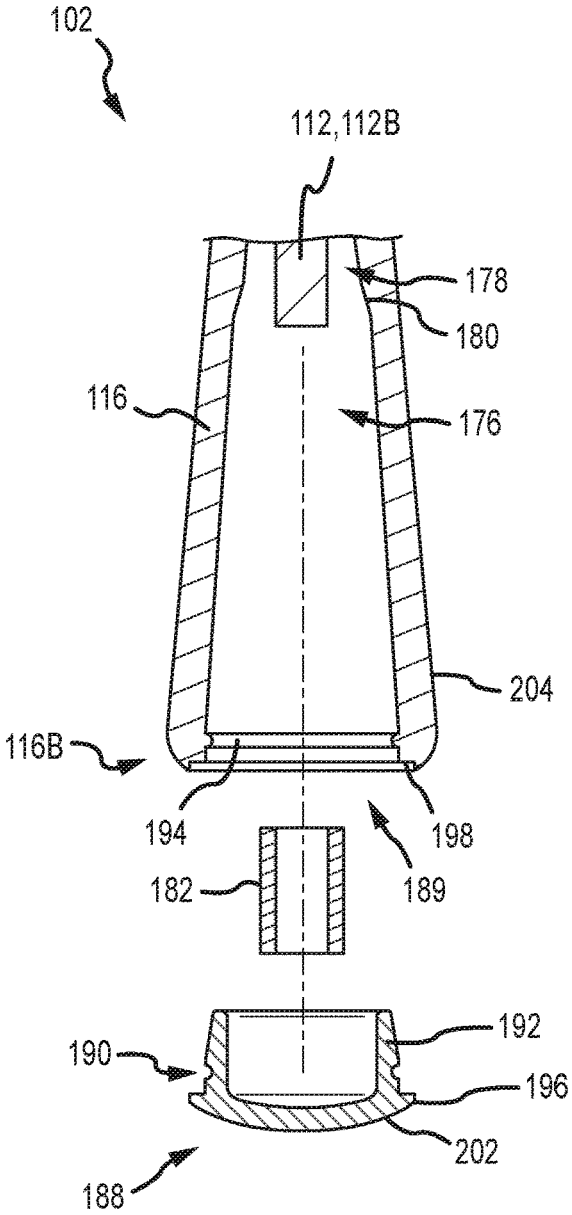
FIG. 5A is an enlarged, fragmentary, partially-exploded cross-sectional view of the lower end of the wand of FIG. 3, the cross-section generally taken along line 5-5 in FIG. 3.
Figure 5B:
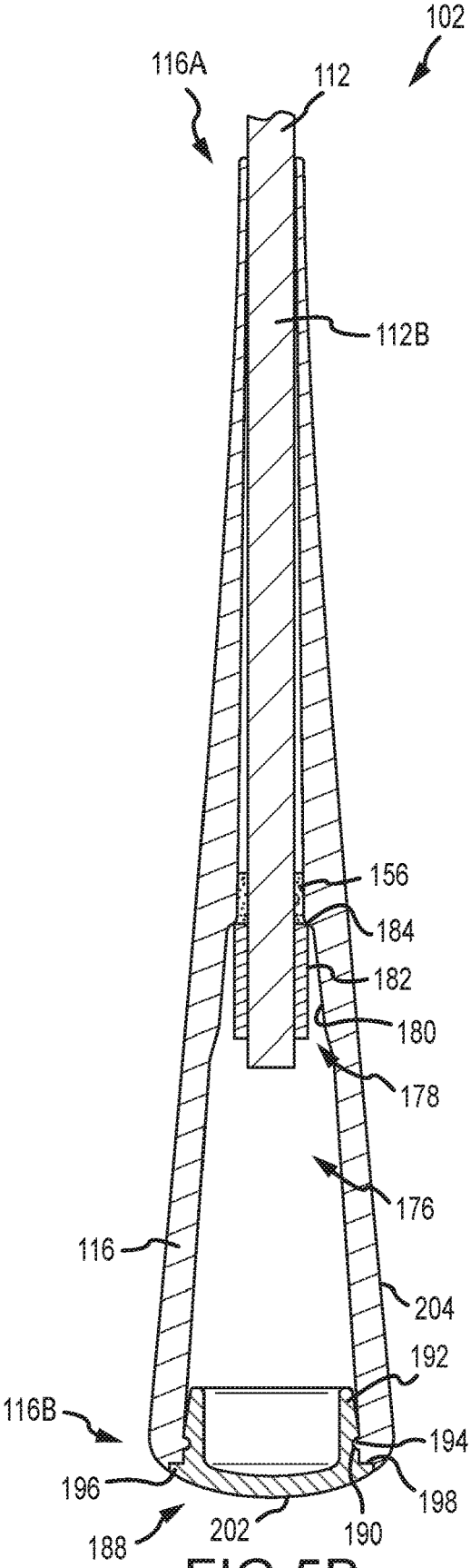
FIG. 5B is an enlarged, fragmentary, cross-sectional view of the lower end of the wand of FIG. 3, taken along line 5-5 in FIG. 3.

Referring to FIGS. 5A and 5B, the handle 116 may be attached to the lower end 112B of the rod 112 to facilitate grasping of the wand 102 by a user. The handle 116 may define an internal bore 176 extending from a first end 116A to a second end 116B of the handle 116. The internal bore 176 may be dimensioned to snugly receive the lower end 112B of the rod 112 near the first end 116A of the handle 116 and may be oversized relative to the lower end 112B of the rod 112 near the second end 116B of the handle 116 to define an annular space 178 between an inner surface 180 of the handle 116 and an outer surface of the rod 112. The internal bore 176 may have less than 0.005" clearance near the first end 116A of the handle 116 for a slip fit with the rod 112, and the bore 176 may taper outwardly as it extends toward the second end 116B of the handle 116 for ergonomics while allowing a slightly larger cavity to receive a collar or sleeve 182 (hereinafter "collar" for the sake of convenience without intent to limit), which may lock onto the rod 112 to counteract forces (such as tension forces) that occur during operation. The collar 182 may be crimped or otherwise attached to the lower end 112B of the rod 112, and the collar 182 may be received in the annular space 178. In embodiments in which the collar 182 is crimped to the rod 112, an inner surface of the collar 182 may be compressed onto the rod 112 to slightly deform the rod 112 and axially secure the collar 182 to the rod 112. An optional coating 118 (see FIG. 6) on the exterior surface of the rod 112 may be slightly compressed or otherwise deformed by the collar 182 and may help retain the collar 182 on the rod 112. The collar 182 may be inserted into the annular space 178 through the open second end 116B of the handle 116, and the collar 182 may abut against an internal step 184 (see FIG. 5B) of the handle 116 to prevent the collar 182 from moving axially toward the first end 116A of the handle 116. The collar 182 may be substantially entirely received within the annular space 178 to substantially conceal the collar 182 within the handle 116.

Referring to FIG. 5B, the rod 112 may be restricted from moving in an axial direction relative to the handle 116. As previously discussed, the collar 182 may restrict movement of the handle 116 relative to the rod 112 in one axial direction. In addition to the collar 182, the handle 116 may be attached to the lower end 112B of the rod 112 with adhesive 156, for example, to further restrict axial movement of the handle 116 relative to the rod 112. The adhesive 156 may also restrict rotation of the handle 116 about a longitudinal axis 158 relative to the rod 112 (see FIG. 4A).

Referring to FIGS. 5A and 5B, the handle 116 may include an optional bottom cap or plug 188 (hereinafter "plug" for the sake of convenience without intent to limit). The plug 188 may close an opening 189 (see FIG. 5A) in the open second end 116B of the handle 116 to provide an aesthetically pleasing appearance and may substantially prevent ingress of dirt or other debris into the internal bore 176 of the handle 116. In such embodiments, the collar 182 may be adhered to the internal bore 176 to prevent movement of the rod 112 relative to the handle 116 so that the rod 112 cannot be moved downwardly with respect to the handle 116 to dislodge the plug 188. The plug 188 may be secured within the open second end 116B such as by a snap fit or other interference-type fit into the open second end 116B of the handle 116. The plug 188 and the handle 116 may include corresponding engaging features, such as corresponding detent and groove features, to provide the interference fit or snap fit or interlocking engagement between the plug 188 and the handle 116. Referring to FIGS. 5A and 5B, the plug 188 may include a recess 190, which may form an annular groove, formed in an exterior of the side wall 192 of the plug 188. The handle 116 may include an inwardly directed detent 194 that is received in the recess 190 when the plug 188 is fitted into the second end 116B of the handle 116. The detent 194 may be formed as an annular ridge projecting inwardly from the inner surface 180 of the handle 116. The plug 188 may include a peripheral flange 196 that may axially abut against an internal shoulder 198 of the handle 116 when the plug 188 is fully inserted into the second end 116B of the handle 116 and the detent 194 is received in the recess 190 to substantially prevent further insertion of the plug 188 into the internal bore 176 of the handle 116.

Referring to FIG. 5B, when fully engaged with the second end 116B of the handle 116, an outer surface 202 of the plug 188 may be substantially flush with or recessed relative to an outer surface 204 of the handle 116. The interface between the plug 188 and the second end 116B of the handle 116 may provide substantially no access to the rim 196 of the plug 188 or the internal bore 176 of the handle 116 for removing the plug 188, such as by prying or otherwise inserting a lever to apply a force that would dislodge the plug 188. The outer surface 202 of the plug 188 may be convex, which may further restrict access to the interface between the plug 188 and the handle 116. The substantially seamless transition from the plug 188 to the handle 116 and/or the flush or inset arrangement of the plug 188 relative to the handle 116 may substantially prevent the plug 188 from being removed from the handle 116.

In one embodiment, the handle 116 may be tapered inwardly from a lower end toward an upper end such that the upper end of the handle 116 provides a substantially seamless transition from the handle 116 to the rod 112. For example, referring to FIGS. 5A and 5B, the outer surface 204 of the handle 116 may taper inwardly toward the rod 112 from the second end 116B to the first end 116A of the handle 116 to provide a substantially seamless transition between the handle 116 and the rod 112. In one embodiment, the tapering of the handle 116 may prevent the collar 182 from passing through the bore 176 in the handle 116, thereby holding the handle 116 on the rod 112. In some embodiments, the outer surface 204 of the handle 116 may be substantially conical. In some embodiments, the second end 116B of the handle 116 may have a different profile than the first end 116A of the handle 116. For example, in some embodiments, the second end 116B of the handle 116 may have an oval or rectangular shaped profile and the first end 116A of the handle 116 may have a circular profile. Other profiles are considered to be within the scope of the present disclosure.

With continued reference to FIGS. 5A and 5B, the wand 102 may be assembled by mounting the connector 114 and the handle 116 to the rod 112. The connector 114 may be mounted first to the rod 112 by crimping the collar 140 to the upper end 112A of the rod 112 and passing the rod 112 through the connector 114. The collar 140 may be crimped to the rod 112 before or after passing the rod 112 through the connector 114. Then, the rod 112 may be passed through the handle 116 and the collar 182 may be crimped to the lower end 112B of the rod 112 to prevent the rod 112 from being pulled through the top end 116A of the handle 116. The plug 188 may close the open second end 116B of the handle 116. The rod 112 and the handle 116 may be fixed against relative movement. For example, the handle 116 may be secured to the lower end 112A of the rod 112 to prevent movement of the handle 116 relative to the rod 112. Optionally adhesive 156 may be applied between an exterior of the rod 112 and an interior of the connector 114 and/or the handle 116 to fix the connector 114 and/or the handle 116 against movement relative to the rod 112. The adhesive 156 may be helpful to substantially prevent relative axial movement which may result in the lower end 112A of the rod 112 dislodging the plug 188 from its position closing the open second end 116B of the handle 116.

Referring to FIGS. 1 and 2, when the operating cord 110 is used with a unidirectional drive system of the type described previously, the wand 102 may be pulled downwardly a predetermined distance, commonly referred to as a down stroke, and during that down stroke the shade 104 may be driven upwardly toward a retracted position or downwardly toward an extended position, such as by a distance determined by the length of the stroke. The downward angle at which the wand 102 is pulled may determine whether or not the shade 104 is raised or lowered. After the wand 102 has completed a downward stroke, the control system for the covering may automatically retract the operating cord 110 upwardly, such as into a generally inaccessible position. At the top of an upward stroke, the end cap 164 of the connector 114 may contact the head rail 106 (see FIG. 1), and the wand 102 may be suspended from the head rail 106.

The components or parts discussed herein may be constructed from various types of materials, including metallic and/or non-metallic materials. In some embodiments, the connector may be formed from a plastic material. In some embodiments, the cap may be formed from an elastomeric material. In some embodiments, the handle may be formed from a plastic material. In some embodiments, the plug may be formed from a plastic material. In some embodiments, the rod may be formed from a fiberglass material, and may be coated with a polymeric material.

The foregoing description has broad application. While the provided examples describe an example shade, it should be appreciated that the concepts disclosed herein may equally apply to many types of shades, including roller shades, stackable shades, blinds, or other types of shades. While the provided examples depict a wand associated with a left end of a head rail, it should be appreciated that the wand may be positioned at a right end of a head rail or other positions along the length of the head rail. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary. It will be appreciated that the cross-section hatching is intended to be generic and is not intended to indicate a particular material, or that all illustrated elements are formed of the same material.

What is claimed is:

1. A covering for an architectural opening, said covering comprising:

a shade movable between extended and retracted positions;

a wand having a rod with a top end and a bottom end, said top end being operatively coupled to said shade via an operating cord and movable to actuate the operating cord to move said shade between said extended and retracted positions; and a handle coupled to said bottom end of said rod;

wherein:

said handle includes a top end and a bottom end, said bottom end of said handle having a larger bottom diameter, said top end of said handle having a smaller top diameter so that said handle tapers from said larger bottom diameter to said smaller top diameter to conform said smaller top diameter of said handle to a diameter of said rod;

a bore is defined in said handle, said bore extending from said top end to said bottom end so that said top end is a top open end and said bottom end is a bottom open end;

said bottom end of said rod is received through said top open end of said bore;

a collar is crimped on said bottom end of said rod to retain said handle on said rod;

said bore including a taper adjacent to said top open end, the tapering of said bore in said top open end preventing said collar from passing through said top open end of said bore in said handle, thereby holding said handle on said wand; and a plug including a closed bottom surface, said plug fitted into said bottom open end of said bore in said handle to close said bottom open end of said bore in said handle, said closed bottom surface of said plug having a smooth continuous surface with said bottom end of said handle.

2. The covering of claim 1, wherein said rod is rigid to resist bending into a loop.

3. The covering of claim 2, wherein said rod is bendable.

4. The covering of claim 1, further comprising a connector coupling said rod to the operating cord, wherein said connector is tapered inwardly from an upper end toward a lower end such that said lower end of said connector provides a substantially seamless transition from said connector to said rod to conform the diameter of said connector to the diameter of said rod.

5. The covering of claim 4, further comprising an elastomeric cap attached to said upper end of said connector.

6. The covering of claim 1, further comprising a head rail, wherein said shade is suspended from said head rail for movement between said extended and retracted positions.

7. The covering of claim 1, wherein said bottom open end of said bore in said handle is spaced inwardly of an outer surface of said handle such that said plug cannot be wedged out of said bore by application of leverage force transverse to said rod.

8. The covering of claim 7, wherein said closed bottom surface of said plug includes a convex outer surface that is substantially flush with said outer surface of said handle.

9. The covering of claim 1, wherein said handle tapers continuously from said larger bottom diameter to said smaller top diameter.

10. A covering for an architectural opening, said covering comprising:

a shade movable between extended and retracted positions;

a wand having a rod with a top end and a bottom end, said top end being operatively coupled to said shade via an operating cord, said wand being movable upwardly and downwardly to actuate the operating cord to move said shade between said extended and retracted positions; and a handle coupled to a bottom free end of said wand, said handle including a plug;

wherein:

said rod has a diameter substantially comparable to the diameter of a flexible shade-operating cord of less than approximately 0.20 inches;

said rod is bendable yet not sufficiently flexible to be able to form a loop upon application of a bending force thereto;

said handle includes a top end and a bottom end, said bottom end of said handle having a larger bottom diameter, said top end of said handle having a smaller top diameter so that said handle tapers from said larger bottom diameter to said smaller top diameter to conform said smaller top diameter to the diameter of said rod; and said plug includes a peripheral flange arranged and configured to axially abut against an internal shoulder formed in said bottom end of said handle when said plug is inserted into said bottom end of said handle.

11. The covering of claim 10, further comprising a head rail, wherein said shade is suspended from said head rail for movement between said extended and retracted positions.

12. A covering for an architectural opening, said covering comprising:

a shade movable between extended and retracted positions;

a wand having a rod with a top end and a bottom end, said top end being operatively coupled to said shade via an operating cord and movable to actuate the operating cord to move said shade between said extended and retracted positions; and a handle coupled to said bottom end of said rod;

wherein:

said handle includes a top end, a bottom end, and a bore extending from said top end to said bottom end, said top end of said handle having a diameter that conforms to a diameter of said rod;

said bottom end of said rod is received through said top end of said bore; and a collar is crimped on said bottom end of said rod to retain said handle on said rod;

said bore including a taper adjacent to said top end, the tapering of said bore in said top end preventing said collar from passing through said top end of said bore in said handle, thereby holding said handle on said wand; and a plug fitted into said bottom end of said bore in said handle, said plug including a closed bottom end for closing said bottom end of said bore in said handle, said bottom end of said plug being substantially flush with said bottom end of said handle to prevent removing of said plug.

* * * * *